US007106159B2

(12) United States Patent
Delamare et al.

(10) Patent No.: US 7,106,159 B2
(45) Date of Patent: Sep. 12, 2006

(54) MOBILE MAGNET ACTUATOR

(75) Inventors: Jérôme Delamare, Grenoble (FR); Christel Locatelli, Grolles (FR); Orphée Cugat, Poisat (FR)

(73) Assignees: Commissariat a l'Energie Atomique, Paris (FR); Centre National de la Recherche Scientifique, Paris (FR); Institut National Polytechnique De Grenoble, Grenoble (FR)

( * ) Notice: Subject to any disclaimer, the term of this patent is extended or adjusted under 35 U.S.C. 154(b) by 344 days.

(21) Appl. No.: 10/485,193

(22) PCT Filed: Jul. 25, 2002

(86) PCT No.: PCT/FR02/02666

§ 371 (c)(1),
(2), (4) Date: Jan. 27, 2004

(87) PCT Pub. No.: WO03/012805

PCT Pub. Date: Feb. 13, 2003

(65) Prior Publication Data

US 2004/0183382 A1 Sep. 23, 2004

(30) Foreign Application Priority Data

Jul. 27, 2001 (FR) ..... 01 10081

(51) Int. Cl.
*H01F 7/02* (2006.01)

(52) U.S. Cl. ..... 335/296; 335/205; 335/207; 335/229; 335/306; 310/90.5

(58) Field of Classification Search ..... 335/205–207, 335/229–231, 296, 306; 310/90.5
See application file for complete search history.

(56) References Cited

U.S. PATENT DOCUMENTS 6,275,127 B1 * 8/2001 French ..... 335/285

FOREIGN PATENT DOCUMENTS

| | | |
|---|---|---|
| CH | 655 983 | 5/1986 |
| EP | 0 179 911 | 5/1986 |
| FR | 2 612 276 | 9/1988 |
| WO | WO 01/16484 | 3/2001 |

OTHER PUBLICATIONS

Abstract of Japanese Patent 09 252570, dated Sep. 22, 1997, entitled, "Magnetic Levitation Linear Actuator".
International Search Report PCT/FR02/02666, dated Jul. 25, 2002.

* cited by examiner

*Primary Examiner*—Ramon M. Barrera
(74) *Attorney, Agent, or Firm*—Thelen Reid & Priest LLP

(57) ABSTRACT

This magnetic actuator comprises a fixed magnetic part (3) cooperating magnetically with a mobile magnetic part (1) and means (4) for initiating movement of the mobile magnetic part (1). The mobile magnetic part (1) comprises at least one magnet (1-1) and the fixed magnetic part (3) has at least two attraction zones (3-2) onto which the mobile magnetic part is able to come to attach itself. The mobile magnetic part (1) levitates when it is not attached to one of attraction zones (3-2), its movement being magnetically guided.

25 Claims, 17 Drawing Sheets

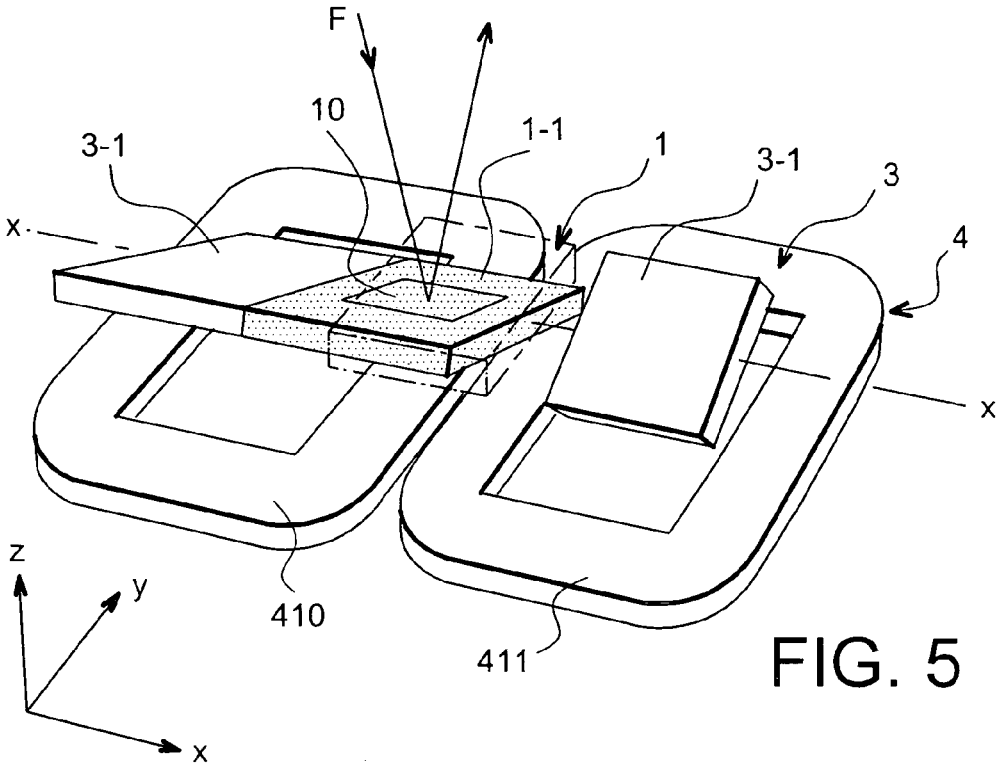
FIG. 5
FIG. 6
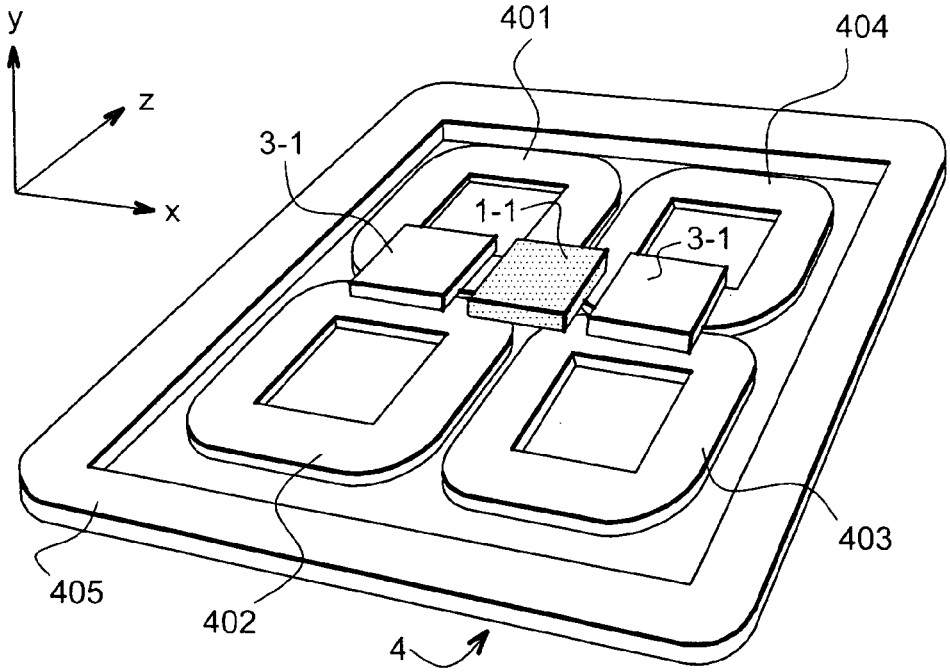

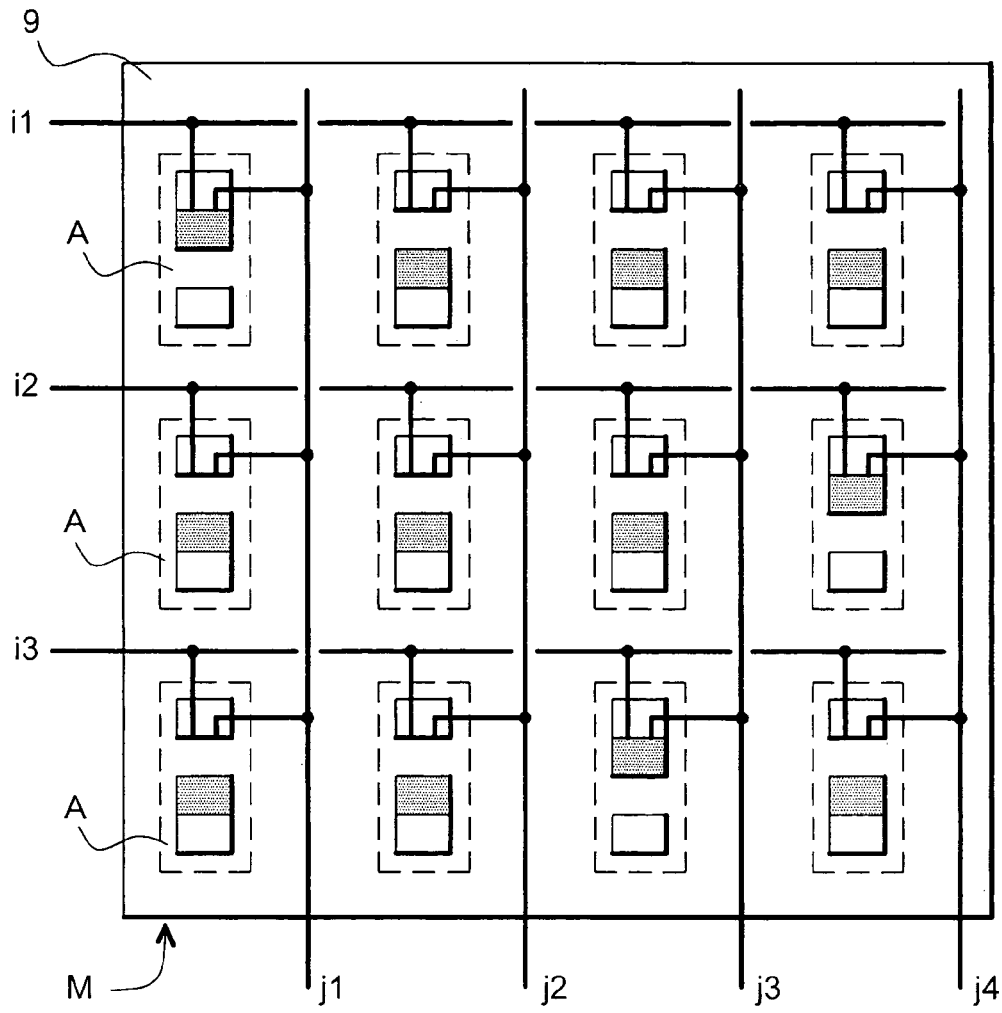
FIG. 9A
FIG. 9B
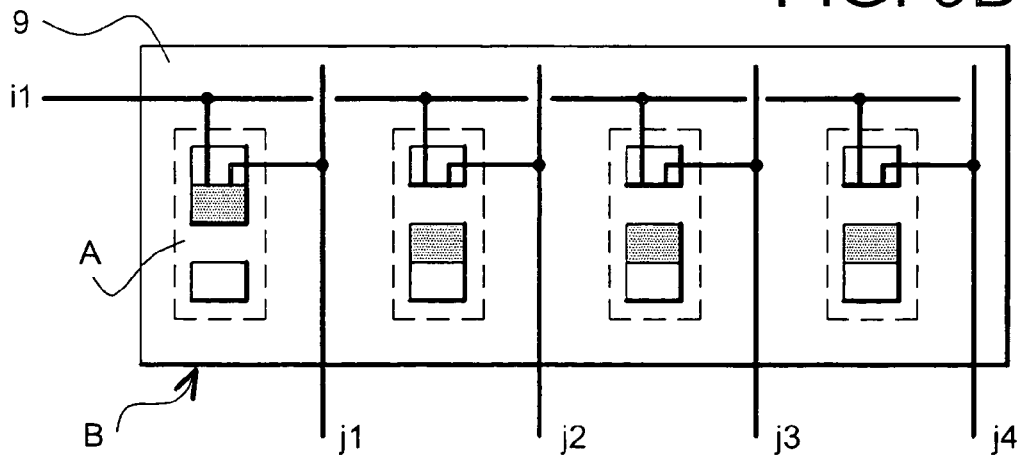

MOBILE MAGNET ACTUATOR

CROSS-REFERENCE TO RELATED APPLICATION

This application claims priority based on International Patent Application No. PCT/FR02/002666, entitled "Mobile-Magnet Actuator" by Jerome Delamare, Christel Locatelli and Orphee Cugat, which claims priority of French application no. 01 10081, filed on Jul. 27, 2001, and which was not published in English.

TECHNICAL FIELD

The subject of the present invention is a magnetic actuator with mobile magnet, in particular a micro-actuator which can be produced using microtechnology techniques.

This actuator, when it has several stable positions, finds application in the fabrication of electric micro-relays or micro-switches commanding the opening or closing of an electric contact which may be one of several, in the fabrication of microrelays or microswitches commanding the passing, shutting, switching or shunting of a light ray, of micro-valves commanding the passing, shutting, or channelling of a fluid, of micropumps commanding the pumping of a fluid.

This actuator may be piloted so as to be able to take up a multitude of successive positions with nanometric accuracy of up to 5 degrees of freedom.

It can in this case be used for positioning a magnetic or optic reading head in optic scanners, to carry out AFM (Atomic Force Microscope) or heat recording in positioning tables.

PRIOR ART

Known magnetic actuators comprise a fixed magnetic part, a mobile magnetic part which is mechanically connected to the fixed magnetic part. An electric circuit is used to excite the mobile magnetic part so that it takes up a working position by causing it to move relative to the fixed magnetic part. If there is no excitation, the mobile magnetic part is in rest position.

In the article "Latching micromagnetic relays with multistrip permalloy cantilevers" by M. RUAN and J. SHEN published in IEEE MENS 2001 page 224 to 227 a magnetic microactuator with magnet is known that is fabricated on a silicon substrate. The magnet is fixed, and is buried in the silicon, it is overlaid with a command winding, and the mobile magnetic part to be moved is in the form of a beam with one free end and one embedded end which is hence mechanically integral with the fixed magnetic part.

Another type of microactuator with magnet has been described on the web site of the IBM research laboratory in Zurich (www.zurich.ibm.com) under the title "Electromagnetic scanner". This article was available in April 2001. The microactuator operates on the loudspeaker principle. Planar windings placed on a substrate command movement of magnets integral with a supporting plate, the latter being mechanically suspended by beams from a fixed frame integral with the substrate.

In all these actuators the mobile magnetic part is mechanically connected to the fixed magnetic part. This mechanical connection is difficult to produce in mass production techniques. Also this connection limits the mobility of the mobile magnetic part, this mobility resulting from deformation of one of the members connecting the mobile part to the fixed part. Performance in terms of speed of such actuators is low.

The driving forces of the mobile magnetic part are due to the magnetic field set up by at least one winding. However, at constant current density, a micro-winding sets up a force that is much weaker than a winding of same shape but of larger size. The performance of such microactuators therefore remains poor. The specific forces they are able to provide are low in relation to their size.

In addition, such actuators need to be electrically supplied so that they remain in work position, if there is no electric supply they return to a rest position.

DESCRIPTION OF THE DISCLOSURE

The subject of the present invention is precisely to propose a magnetic actuator which does not have all these disadvantages. The actuator of the present invention is particularly suitable for microtechnology fabrication. It has high speed of movement, the capacity to exert major specific forces and to provide considerable movement relative to its size. In stable position, a position which may correspond to working position, the electric consumption of this actuator is zero.

To achieve this, the actuator of the invention comprises a fixed magnetic part and a mobile magnetic part consisting of a magnet which, when it is not attached to the fixed magnetic part, is put into contactless levitation. When it moves and is attracted by the fixed magnetic part, it is entirely magnetically guided. There is no mechanical guiding.

More precisely, the magnetic actuator of the invention comprises a fixed magnetic part cooperating magnetically with a mobile magnetic part, and means for initiating movement of the mobile magnetic part. The mobile magnetic part comprises at least one magnet and the fixed magnetic part has at least two attraction zones onto which the mobile magnetic part is able to come to attach itself, the mobile magnetic part levitating when it is not attached to one of the attraction zones, its movement being magnetically guided.

The fixed magnetic part may be made in a material chosen from among the group of soft magnetic materials, hard magnetic materials, hysteresis materials, supraconductor materials, diamagnetic materials, these materials being used alone or in combination.

The means for initiating movement of the mobile magnetic part are magnetic means, they may be means for heating the fixed magnetic part.

The Curie temperature of the material of the fixed magnetic part may be lower than that of the magnet of the mobile magnetic part, so that heating does not disturb the properties of the magnet. If this is not the case, consideration must be given to thermal coupling, the magnet of the mobile magnetic part can be heat insulated from the fixed magnetic part.

In another embodiment, the means for initiating movement of the mobile magnetic part set up a magnetic field in the vicinity of the mobile magnetic part.

In this case, the means for initiating movement of the mobile magnetic part may consist of at least one electric conductor.

The actuator may comprise means for servo-controlling the current to be circulated in the conductor in relation to the position of the mobile magnetic part so that the latter can take up a plurality of stable positions when levitating. It can then function as a positioner. The means for initiating movement of the mobile magnetic part can therefore be used to hold the mobile magnetic part stable when it levitates.

The conductor may surround the fixed magnetic part.

Preferably, in particular if the actuator is produced using microtechnology, the conductor may be in the form of a substantially planar winding.

The fixed and mobile magnetic parts may also be substantially planar, they may be arranged substantially in the same plane.

The conductor firstly and the fixed and mobile magnetic parts secondly may then be arranged in substantially parallel planes.

The fixed magnetic part may be in a single part surrounding the mobile magnetic part, the latter then being able to take up several stable positions inside the fixed magnetic part. In this way it can have at least four degrees freedom.

In another embodiment, the fixed magnetic part may consist of several members, the mobile magnetic part coming to attach itself onto one or other of the members of the fixed magnetic part.

If the fixed magnetic part comprises several planar members oriented along different planes, the mobile magnetic part can then assume the orientation of the member to which it is attached.

Magnetisation of the fixed magnetic part and of the mobile magnetic part can be directed in one same direction, or on the contrary be directed in opposite directions.

The means for initiating movement of the mobile magnetic part may initiate rotational movement.

The fixed magnetic part may, at least at one attraction zone, comprise a pair of electric contacts and the mobile magnetic part at least one electric contact, the mobile magnetic part connecting the two contacts of the pair when it attaches itself onto the attraction zone.

The mobile magnetic part may comprise a reflective zone intended to reflect a light ray, the actuator then possibly being used as an optic relay or switch, as a scanner for example following the movement able to be made by the mobile magnetic part.

Said actuator can be produced on an a magnetic substrate, the means for initiating movement of the mobile magnetic part being embedded in the substrate.

A matrix of actuators may be fabricated with a plurality of magnetic actuators as described, these magnetic actuators being grouped together on one same carrier.

The present invention also concerns a device which uses at least one magnetic actuator as defined. This may be a relay for example, a switch, a pump, a valve, a positioner, an optic scanner.

The present invention also pertains to a method for fabricating a magnetic actuator. It comprises the following steps:

- on a first substrate fabrication of chambers able to receive a fixed magnetic part and a mobile magnetic part with magnet,
- depositing the fixed magnetic part and the mobile magnetic part with magnet in the chambers;
- depositing a dielectric layer and etching this layer to expose the mobile magnetic part and its surround as far as the fixed magnetic part;
- on a second substrate, fabricating at least one chamber able to receive a conductor intended to initiate movement of the mobile magnetic part;
- depositing the conductor in the chamber,
- assembling the two substrates, placing them face to face;
- full or partial removal of the first substrate so as to free the mobile magnetic part.

It also comprises a magnetisation step for the magnet of the mobile magnetic part and optionally the fixed magnetic part before releasing the mobile magnetic part.

The etching step of the dielectric layer of the first substrate is also intended to make at least one opening to access at least one electric contact supplying the conductor.

A step may be included to fabricate at least one electric contact to supply the conductor on the second substrate, after depositing the conductor and before assembling the two substrates together.

A step to deposit dielectric material on the surface of the second substrate may be made before assembling the two substrates, to protect the conductor.

The two substrates may be solid semiconductor substrates or SOI-type substrates.

SHORT DESCRIPTION OF THE DRAWINGS

The present invention will be better understood on reading the description of examples of embodiment given solely by way of indication and in no way restrictive, with reference to the appended drawings in which:

FIG. 5 shows an example of an actuator of the invention fabricated on an amagnetic substrate;

FIG. 6 shows an example of actuator of the invention which can be controlled with five degrees of freedom;

FIGS. 9A and 9B show actuators of the invention grouped together on one same carrier and arranged in a matrix;

DETAILED DESCRIPTION OF PARTICULAR EMBODIMENTS

Figure 1A:
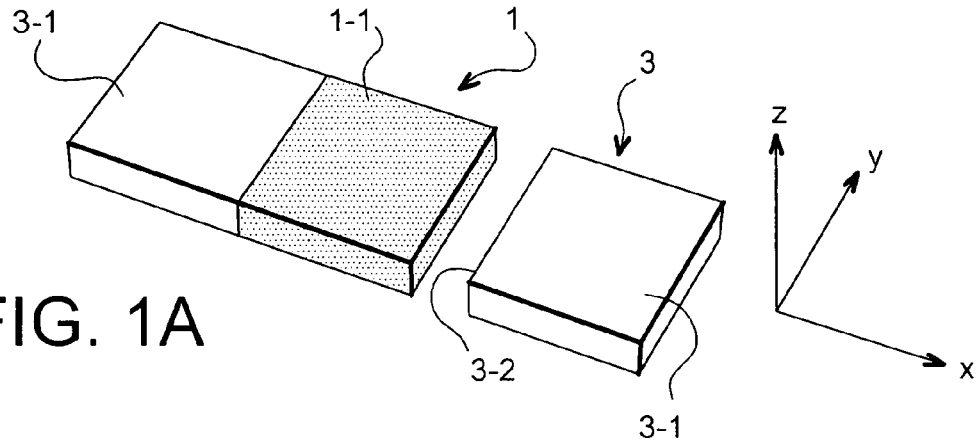
FIGS. 1A to 1D show an example of a switch according to the invention, in different positions which its mobile magnetic part is able to take up.

Reference is made to FIGS. 1A to 1D which schematically illustrate an actuator of the invention and different positions which its mobile magnetic part can assume.

It comprises a mobile magnetic part 1 with at least one permanent magnet 1-1. It also comprises a fixed part 2 consisting of a fixed magnetic part 3 and of means 4 for initiating movement of mobile magnetic part 1. Reference 2 of the fixed part is only indicated in FIG. 1B which shows the means 4 for heat initiating movement of the mobile magnetic part, these are fixed. The fixed magnetic part 3 may comprise one or more members containing permanent magnets 3-1 and/or magnetic material. In FIG. 1, it is assumed that the fixed magnetic part 3 comprises two members 3-1 which are permanent magnets. The assembly of the mobile and fixed magnetic parts is carried by an amagnetic carrier (not shown in FIG. 1). During fabrication of said actuator in microtechnology it may be fabricated on or in a substrate as will be seen below. The fixed magnetic part 3 and the mobile magnetic part 1 cooperate magnetically together.

The fixed magnetic part 3 is configured so as to have at least two attraction zones 3-2 which separately and naturally attract mobile magnetic part 1.

In the example in FIG. 1, the mobile magnetic part 1 is limited to a single permanent magnet 1-1 in the form of a parallelepiped wafer. It is located between the two permanent magnets 3-1 of fixed magnetic part 3 and these are also in the form of a parallelepiped wafer. Attraction zones 3-2 are side faces of fixed magnets 3-1.

Mobile magnet 1-1 is able to come to attach itself either onto one of faces 3-2 of the right fixed magnet or onto one of faces 3-2 of the left fixed magnet, these two faces facing one another. The three magnets 1-1 and 3-1 are aligned and extend substantially along plane x, y.

Mobile magnetic part 1 is devoid of a permanent mechanical connection with fixed part 2. When mobile magnetic part 1 is not attached to one of attraction zones 3-2, it is free, levitating without contact through the interactions it has with fixed magnetic part 3. When it moves it is magnetically guided.

The function of means 4 for initiating movement of mobile magnetic part 1 is to modify the forces which interact on mobile magnetic part 1 and hence to modify the equilibrium of the assembly of mobile magnetic part 1/fixed magnetic part 3. They initiate movement of mobile magnetic part 1 but subsequent movement is due to interactions between fixed magnetic part 3 and mobile magnetic part 1.

Means 4 for initiating movement are magnetic means. They may act following several different physical principles. They may, through localised temperature rise, modify the magnetic characteristics of fixed magnetic part 3 at attraction zone 3-2 onto which mobile magnetic part 1 is attached. In one variant, they may set up a magnetic field at the mobile magnetic part, this magnetic filed modifying the magnetic characteristics of the assembly and setting in movement the mobile magnetic part.

It is the first principle which is illustrated in FIG. 1. In this configuration, each of magnets 3-1 of fixed magnetic part 3 is provided with a heat resistance R. This resistance R may be deposited one of the faces of magnets 3-1 of the fixed magnetic part. It may be made in copper, silver, gold, in aluminium for example. Once movement is initiated, heating may be stopped and there is no further need for energy. When mobile magnetic part is attached onto the fixed magnetic part, energy consumption is also zero.

Instead of heating with a resistance, it is possible to use a light beam, a laser beam for example which irradiates the fixed magnetic part at the zone whose magnetic properties it is wished to modify.

Fixed magnetic part 3 can then be made in a material whose Curie temperature is low, for example 100° C. or lower. It can lose its magnetic properties with temperature increase. For example, the material used is magnetic below 100° C. and amagnetic above 100° C. The temperature reached by the fixed magnetic part during heating must not disturb the behaviour of the magnet of the mobile magnetic part which can then have a higher Curie temperature. The Curie temperature of the magnet of the mobile magnetic part may not necessarily be lower than that of the fixed magnetic part, but in this case the magnet of the mobile magnetic part must have low thermal coupling with the fixed magnetic part so that it does not heat when the fixed magnetic part is heated.

In FIG. 1A, mobile magnet 1-1 is attached to left fixed magnet 3-1. Once it finds itself in said stable position, the magnetic forces are so strong that even a violent impact would not manage to detach it. For example, with mobile and fixed magnets having a size of 50 μm×50 μm×10 μm, provided with 1 Tesla magnetisation, an impact largely greater than 1000 G would be needed to detach it and move it over 1 μm.

Figure 1B:
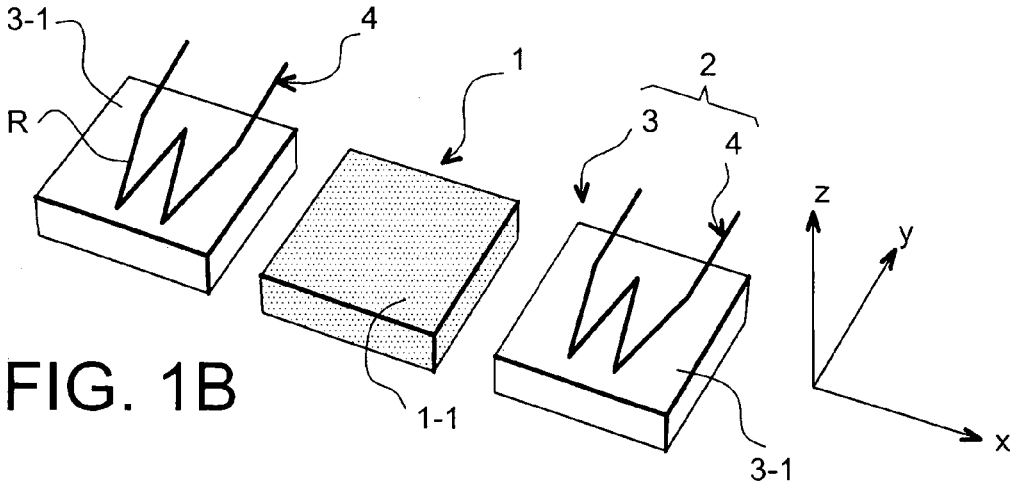
Figure 1C:
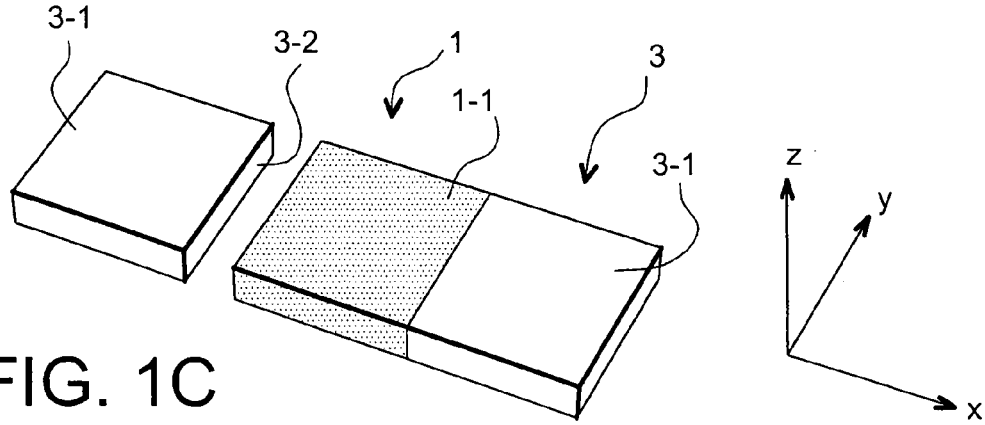
Figure 1D:
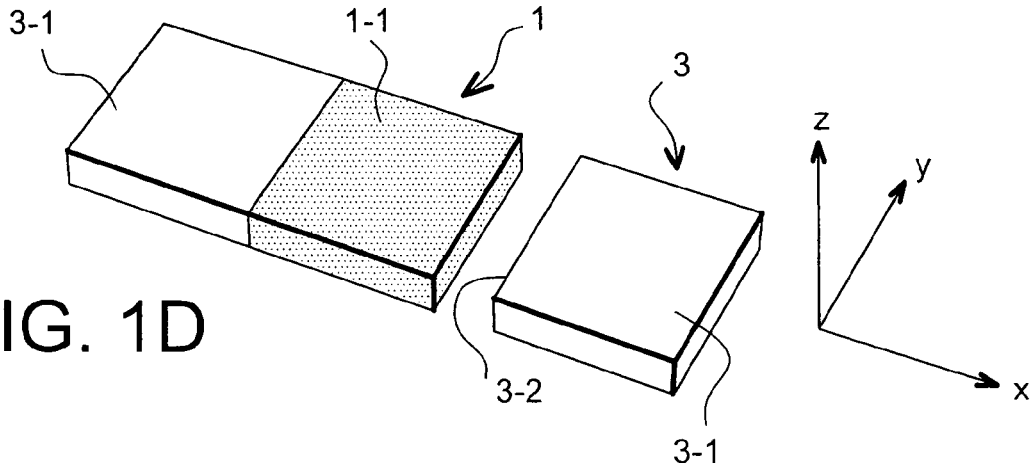

If left fixed magnet 3-1 is heated, it loses its magnetic properties, mobile magnet 1-1 detaches itself, is set in movement and is attracted by right fixed magnet 3-1. It attaches itself to right fixed magnet 3-1 and takes up another stable position. In FIG. 1B, mobile magnet 1-1 levitates between left fixed magnet 3-1 and right fixed magnet 3-1 which attracts it. In FIG. 1C, mobile magnet 1-1 is now attached to fixed right magnet 3-1, it remains in this position which is stable. Left fixed magnet 3-1, which is no longer heated, resumes its magnetic properties.

To return to the first stable position, right fixed magnet 3-1 needs only to be heated. Left fixed magnet 3-1 attracts mobile magnet 1-1 since its magnetic properties have been restored.

Fixed magnetic part 3 and mobile magnetic part 1 may be provided with electric contacts as illustrated in FIGS. 2A, 2B, 2C, 2D.

At least one attraction zone 3-2 of fixed magnetic part 3 is provided with a pair of electric contacts C1, C2, these contacts extending beyond attraction zone 3-2 to be accessible. Mobile magnetic part 1 is provided with at least one electric contact C. When mobile magnetic part 1 is attached to attraction zone 3-2, its contact C electrically connects the two contacts C1, C2 of the pair. In this manner an electric relay can be obtained.

Figure 2A:
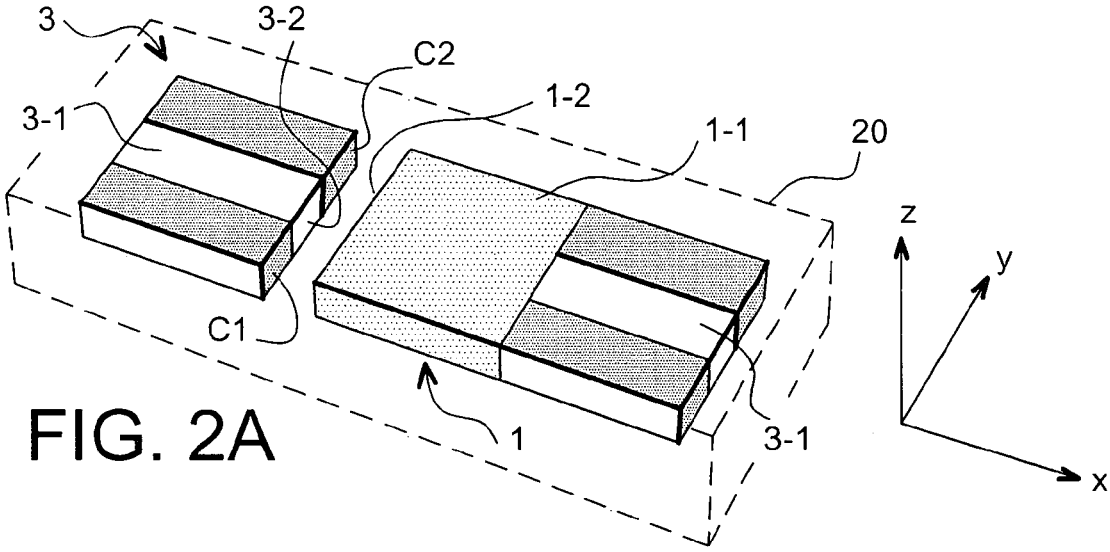
FIGS. 2A, 2B, 2C and 2D show examples of actuators of the invention operating as electric switches.
Figure 2B:
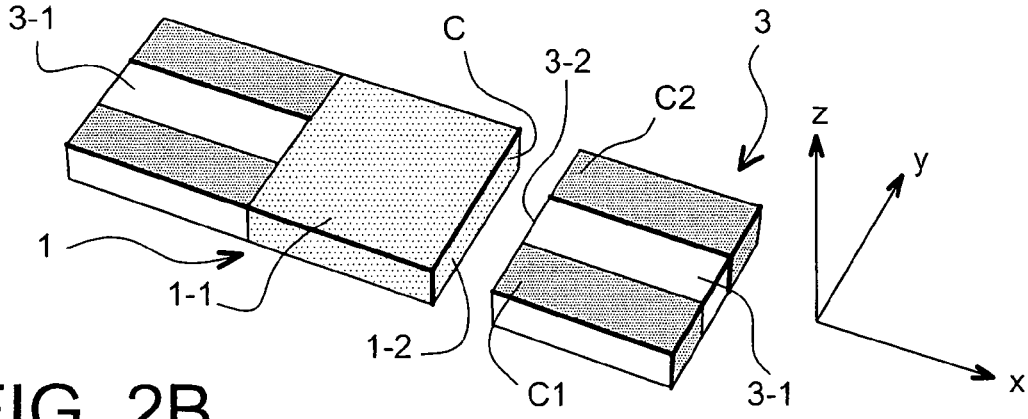

In FIGS. 2A, 2B, the two fixed magnets 3-1 are provided with contacts C1, C2 and mobile magnet 1-1 has two of its faces 1-2 each provided with a contact C (contact C on its face 1-2 which comes into contact with left fixed magnet 3-1 is not visible in FIGS. 2A, 2B). In this way, a device 20 is produced, of electric switch type for example, comprising at least one magnetic actuator of the invention.

Figure 2C:
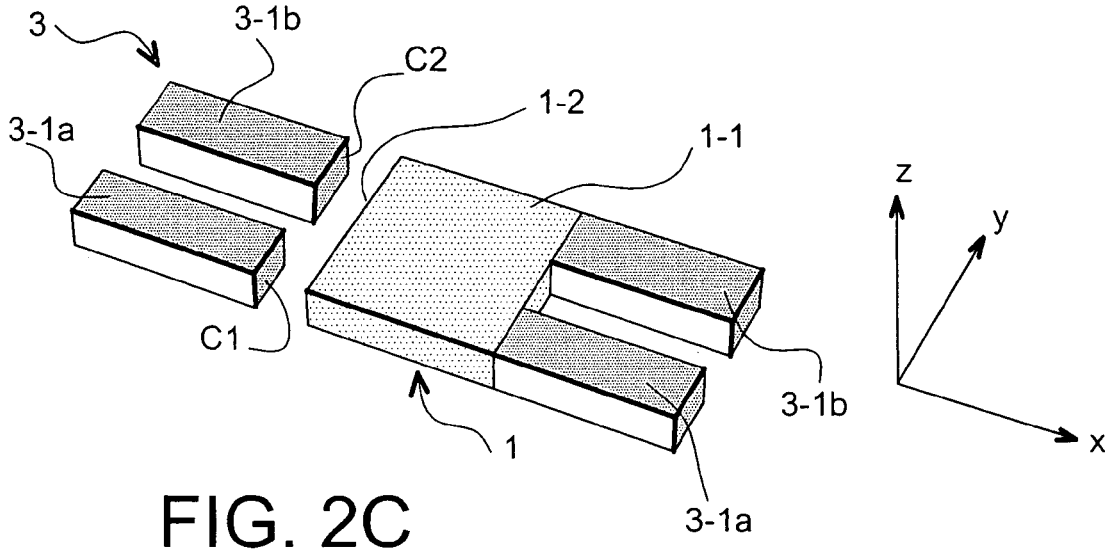
Figure 2D:
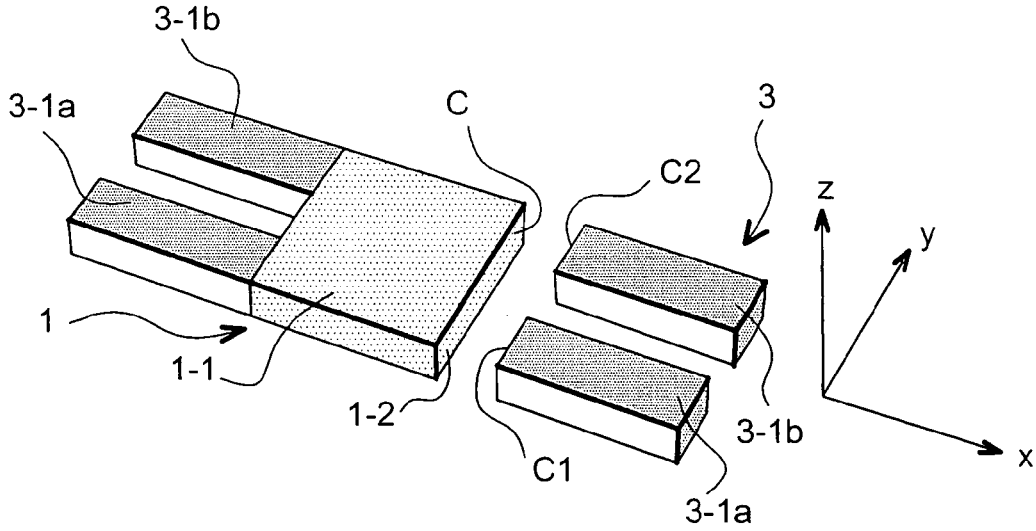

In FIGS. 2C, 2D, instead of consisting of two members 3-1 each provided with a pair of electric contacts, the fixed magnetic part consists of two pairs of members 3-1*a*, 3-1*b*. Members 3-1*a*, 3-1*b* of a pair are side by side but not joined. Each of members 3-1*a*, 3-1*b* of the pair is provided with an electric contact C1, C2 respectively. There is no change in respect of mobile magnetic part 1.

In the configurations in FIGS. 1 and 2, magnetisation of the fixed and mobile magnetic parts is directed in the same direction along axis x.

Figure 3A:
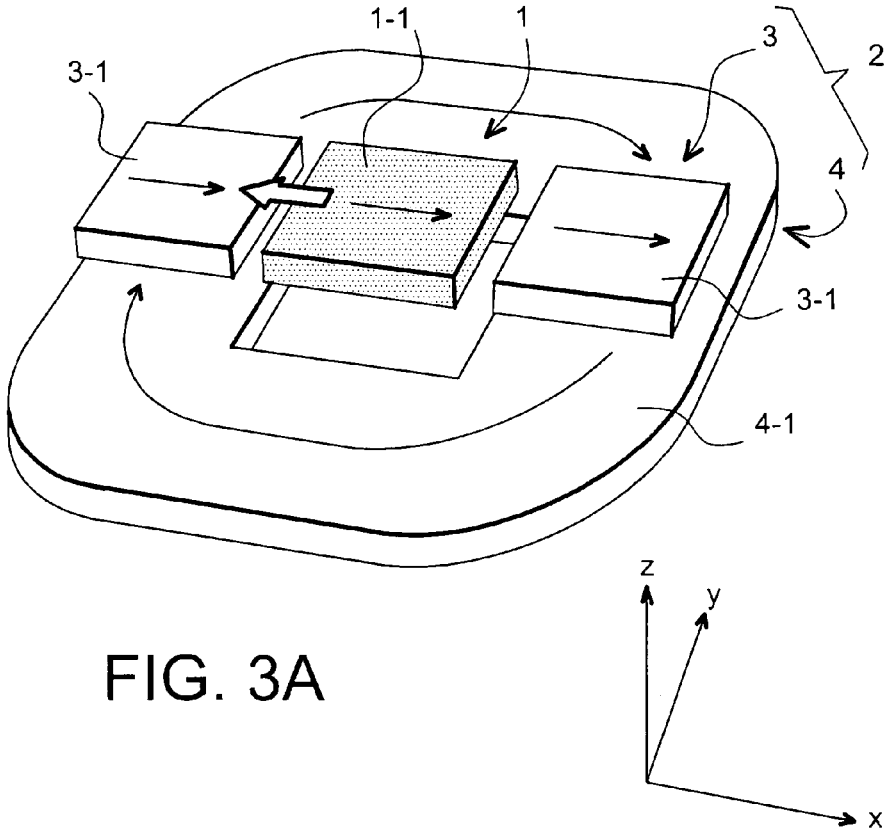
FIGS. 3A to 3C show different configurations of the means for initiating movement of the mobile magnetic part of an actuator according to the invention.

Reference will now be made to FIG. 3A. The only difference relative to the preceding figures is found in means 4 for initiating movement of mobile magnetic part 1. Their principle here is to set up a magnetic field in the vicinity of the mobile magnetic part. These means 4 may consist of at least one conductor 4-1 through which an electric current is intended to pass in order to generate the magnetic field. Conductor 4-1 may have a large number of configurations, for example it may be in the form of an open loop or a winding with one or several coils. In the remainder of the description, when the term winding is used, it may also concern a conductor in appropriate form to generate the magnetic field without however being a winding.

In the example in FIG. 3A, there is only one winding 4-1, substantially planar and extending along plane x, y. The winding comprises one or several turns wound around an empty central part, the fixed magnetic part 3 is located in the vicinity of the coils and mobile magnetic part 1, when it levitates, is located close to the central part of winding 4-1. When a current impulse passes through this winding 4-1, a magnetic field is set up and its effect is to modify the magnetic equilibrium of the fixed 3 and mobile 1 magnetic parts and to initiate movement of mobile magnetic part 1 from one stable position towards another. The required impulse for changing over from one position to another may be less than 5 μs for the actuator whose characteristics are given above. The remainder of the actuator does not consume any energy. An actuator with a switching rate of one thousand times per second would consume approximately 2 mW which is very low. With high quality magnetic materials, this consumption could be reduced.

The fixed magnetic part 3 may lie upon winding 4-1 while the mobile magnetic part 1 levitates above it. Appropriate insulation is inserted between the fixed magnetic part and the winding.

The direction of movement is determined by the direction of the current circulating in winding 4-1. For example, with a current circulating in winding 4-1 in clockwise direction and magnetisation of the fixed 3-1 and mobile 1-1 magnets in the direction of axis x, mobile magnet 3-1 will be attracted towards the left fixed magnet 3-1.

Figure 3B:
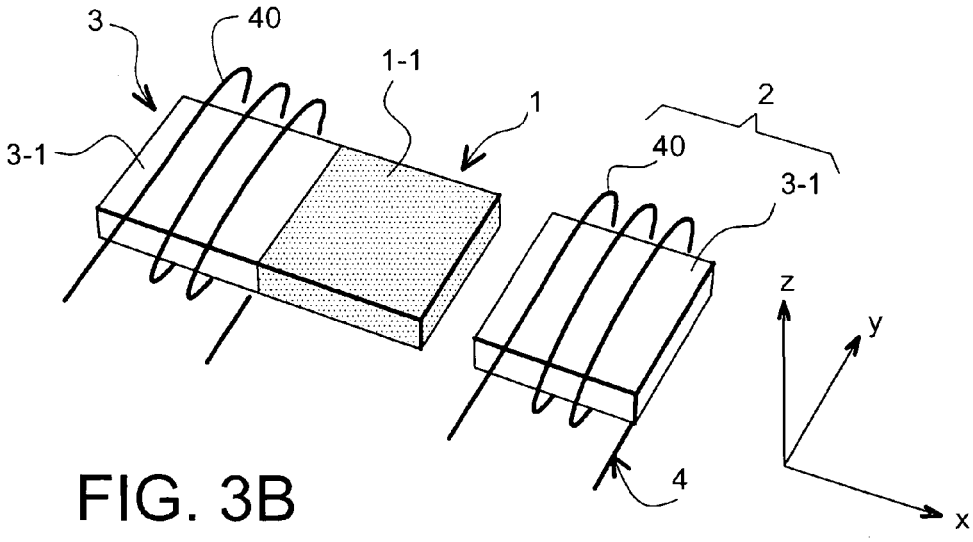

In FIG. 3B, the means 4 for initiating movement of mobile magnetic part 1 consist of two conductors 40 which each surround one of the members of the fixed magnetic part. They are in the form of tubular windings.

For the fixed magnetic part, it is possible to use soft magnetic materials, hard magnetic materials, hysteresis magnetic materials, diamagnetic materials, supraconductor materials, these materials being used alone or in combination. Soft magnetic materials such as iron, nickel, alloys of iron-nickel, iron-cobalt, iron-silicon magnetise in relation to an inductor field to which they are subjected. Hard magnetic materials correspond to magnets such as magnets in ferrite, magnets in samarium-cobalt, magnets in neodymium-iron-boron, platinum-cobalt magnets. Their magnetisation depends little upon the outside magnetic field. Hysteresis materials, of aluminium-nickel-cobalt (AlNiCo) type for example have properties lying between those of soft magnetic materials and those of hard magnetic materials. They are sensitive to the magnetic field in which they are positioned. As for diamagnetic materials such as bismuth or pyrolitic graphite, their magnetisation is co-linear to the inductor magnetic field but in opposite direction. Supraconductor materials could be alloys of niobium-titanium (NbTi), yttrium-barium-copper-oxygen (YBaCuO) for example.

The magnet of the mobile magnetic part may be made in ferrite for example, in samarium-cobalt, in neodymium-iron-boron, in platinum-cobalt.

Magnetic materials with a low Curie temperature suitable for making the fixed magnetic part are for example alloys of manganese-arsenic (MnAs), cobalt-manganese-phosphorus (CoMnP), erbium-iron-boron (ErFeB).

Figure 3C:
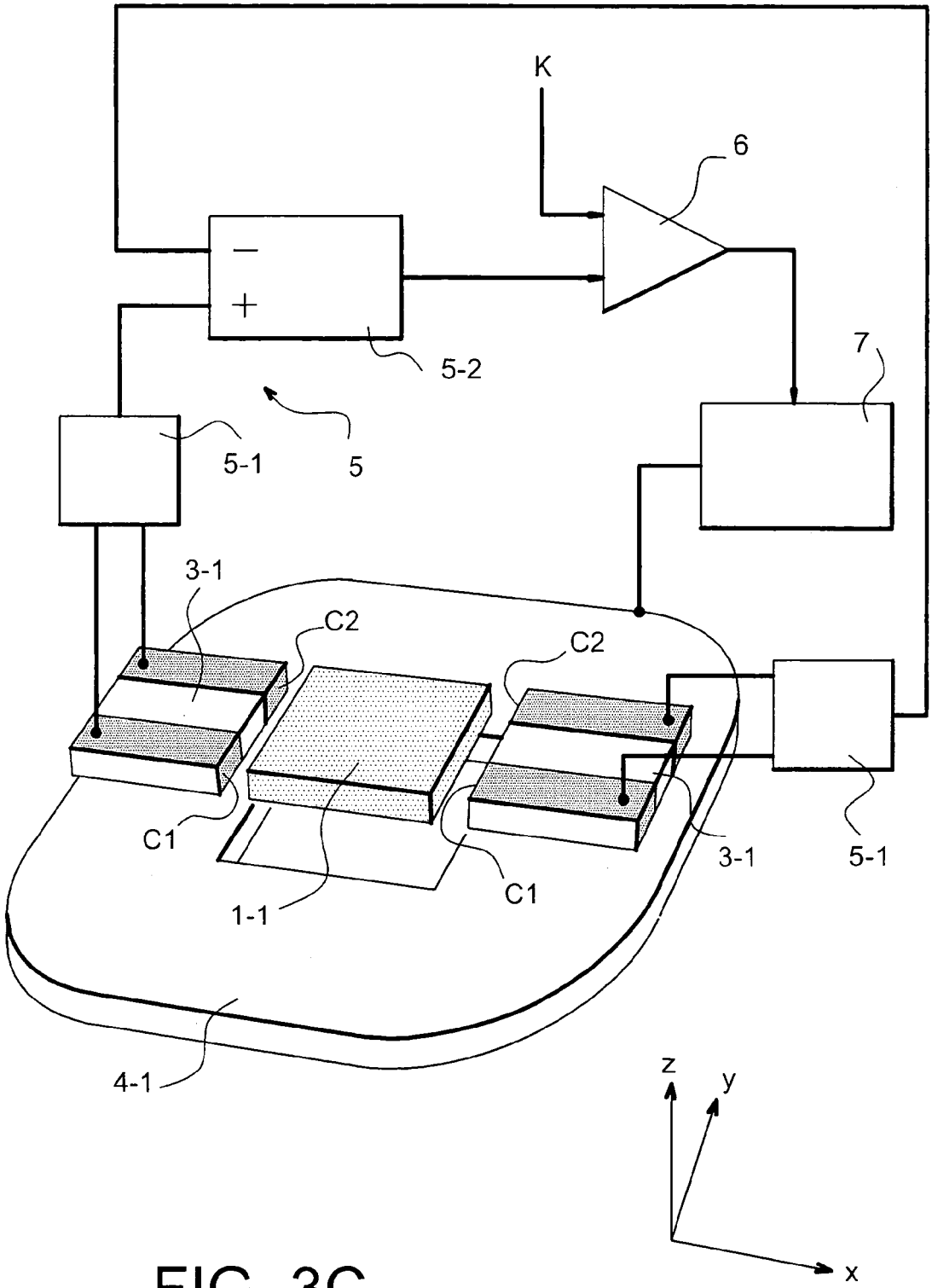

In FIG. 3C, the actuator of the invention is converted into a positioner. In this configuration mobile magnetic part 1 is able to take up a plurality of intermediate positions between two extreme stable positions which correspond to the cases in which it is attached to fixed magnetic part 3. Instead of sending a current impulse into conductor 4-1, the current circulating in conductor 4-1 can be servo-controlled in relation to the position of mobile magnetic part 1.

The means for initiating movement of mobile magnetic part are then used to hold the mobile magnetic part in a stable position when it levitates.

A device 5 may be used which detects the position of mobile magnetic part 1. The signal delivered by this device 5 is compared with a set point K in a comparator 6 and the result of this comparison is used to command a supply source 7 intended to supply conductor 4-1.

Device 5 which detects the position of mobile magnetic part 1 may, in association with each of fixed magnetic members 3-1, comprise a capacitive position sensor 5-1 which measures the capacity existing between fixed magnetic member 3-1 with which it is associated and mobile magnetic part 1.

A differentiating device 5-2 receives signals from the two capacitive position sensors 5-1, calculates the difference and delivers a signal representative of the position of mobile magnetic part 1.

The configurations previously described for FIGS. 1 to 3 have the advantage of allowing the use of magnets of average quality. It is recalled that a magnet sets up a magnetic field which tends to demagnetize it. The intensity of this phenomenon depends upon the direction of magnetization relative to the shape of the magnet. This demagnetisation phenomenon has greater intensity when magnetization follows a short side of the magnet and it is less intense when magnetization is directed along a long side of the magnet, which is the case in these figures, with magnetization directed along axis x.

At the present time, magnets compatible with mass production technologies are sensitive to demagnetization, but by magnetizing them in a direction which follows one of their longer sides, this disadvantage is attenuated.

The magnets, whether they belong to the fixed magnetic part or to the mobile magnetic part, can therefore be produced in simple manner and in a single operation since they are all magnetized in the same direction.

Figure 4:
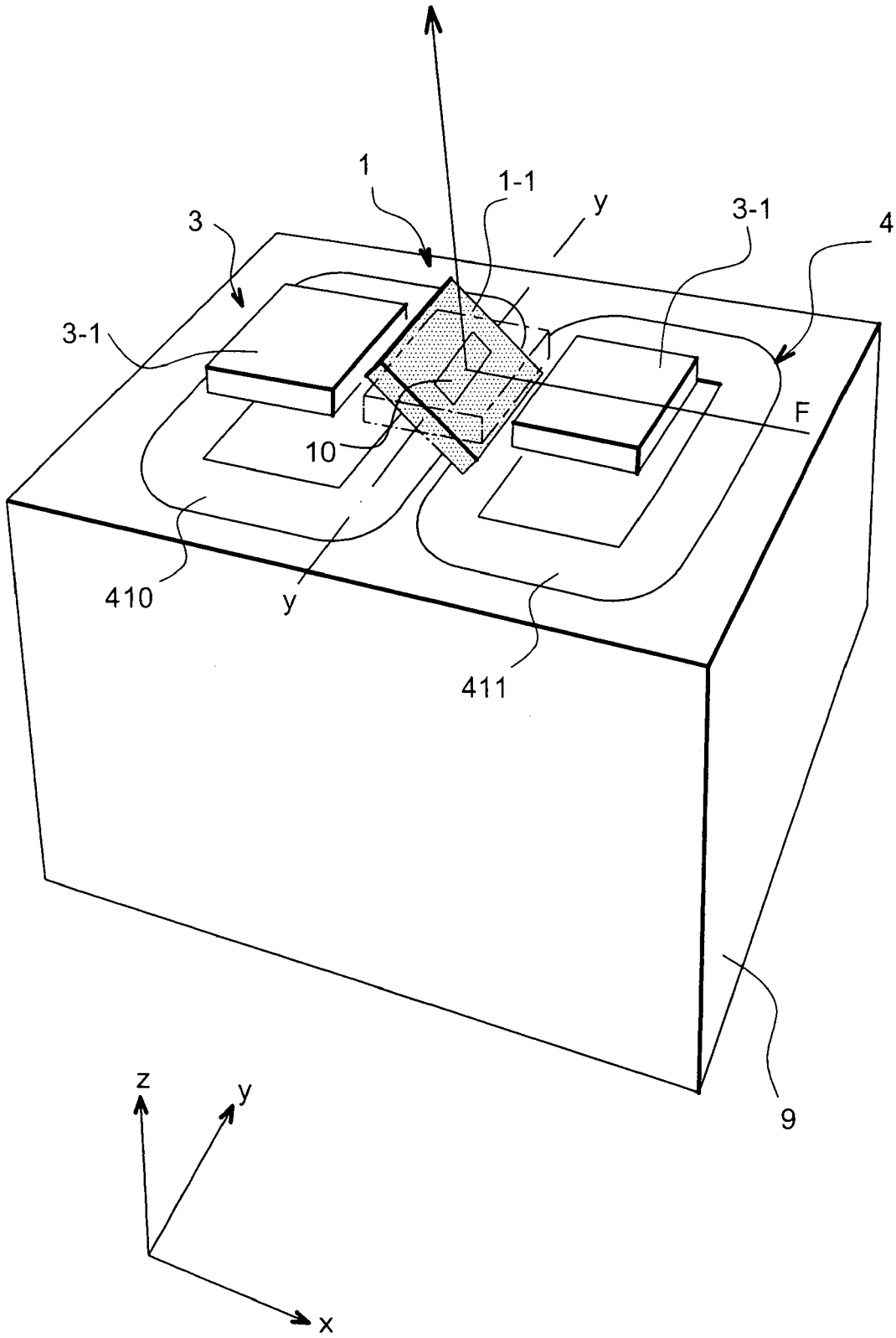
FIG. 4 shows an example of an actuator of the invention made on an amagnetic substrate.

FIG. 4 shows a variant of an actuator of the invention made on a substrate 9, a silicon wafer for example. It may have a thickness of 300 μm if the mobile and fixed magnetic parts have the above-mentioned size (50 μm×50 μm×10 μm).

In this configuration, the fixed magnetic part 3 is added onto the surface of substrate 9, the mobile magnetic part 1, when it is not attached to fixed magnetic part 3, floating above substrate 9 in the magnetic field set up by fixed magnetic part 3, and means 4 for initiating movement of mobile magnetic part 1, being embedded in substrate 9.

The mobile 1 and fixed 3 magnetic parts may be fabricated in similar manner as for FIGS. 1 to 3, but other configurations are possible. Instead of consisting of two members, the fixed magnetic part may be solid. Instead of being magnet-based it could be made in a ferromagnetic material.

It is assumed that magnetization of the fixed and mobile magnetic parts now follows axis z instead of following axis x. This magnetization follows the thickness of the mobile and fixed magnetic parts which are in wafer form. But these magnetizations are in opposite direction. The two wafers 3-1 of magnet or ferromagnetic material of fixed magnetic part 3 have magnetization in the same direction, while the magnetization of magnet 1-1 of mobile magnetic part 1 is in opposite direction. If wafers 3-1 of fixed magnetic part 3 are ferromagnetic, their magnetization depends upon the magnetization of magnet 1-1 of mobile magnetic part 1, it is evidently opposite to that of mobile magnetic part 1.

Means 4 for initiating movement of mobile magnetic part 1 are appropriately modified so as to be efficient. In this example they consist of two substantially planar windings 410, 411, placed side by side in the same plane along axis x. Each of these windings 410, 411 is comparable with the one shown in FIG. 3A. But in this case mobile magnetic part 1 straddles coil portions of each of windings 410, 411.

The two windings 410, 411 can be supplied in series, in parallel or independently from one another. No supply source is shown so as not to encumber the figure. By creating dissymmetry in the currents passing through the two windings 410, 411 it is possible to drive mobile magnetic part 1 in rotation around axis y when it is levitating.

If a portion 10 of mobile magnetic part 1 is made reflective, and if the current is adjusted in windings 410 411, it is possible to control the angle of reflection of an incident light beam F on the reflective surface. In this example, this portion 10 is located on the main upper face of mobile magnetic part 1. In this way an optic scanner can be obtained. It could be imagined that portion 10 is located on an edge of mobile magnetic part 1 or on its main lower face is substrate 9 so permits. The latter could be provided with an opening through which light beam F may pass if it is made in glass for example.

Mobile magnetic part 1 has a resonance frequency, and by making use of this frequency it is possible to fabricate an optic scanner with very low electric consumption. This supply corresponds to the supply injected into the windings to obtain rotation of the mobile magnetic part when it levitates and hence the desired scanning of light beam F. With resonance, very little energy needs to be supplied to the system to cause it to oscillate. In theory, one impulse is sufficient to cause it to oscillate indefinitely.

FIG. 5 illustrates a variant of the previous configuration. The two members 3-1 of fixed magnetic part 3, instead of being in the same plane have dissymmetrical form or position relative to mobile magnetic part 1. In this example, they are inclined relative to one another. In FIG. 5, they are inclined around axis x. Mobile magnetic part 1 when comes to attach itself to one of members 3-1 of the fixed magnetic part assumes the inclination as this member. If mobile magnetic part 1 is provided with a reflective portion 10, a light ray F reflecting upon this portion 10 will be deviated at an inclination which depends upon the inclination of the fixed magnetic part onto which mobile magnetic part attaches itself. In this way an optic switch is obtained.

FIG. 6 is an actuator of the invention deduced from the configuration in FIG. 4. Here means 4 for initiating movement of mobile magnetic part 1 comprise four planar windings 401, 402, 403, 404, positioned in one same plane x, y and arranged in a matrix. The mobile magnetic part overlaps a portion of the coil of the four windings 401, 402, 403, 404 and each member 3-1 of fixed magnetic part 3 overlaps a coil portion of two of windings 401, 402, 403, 404. With said configuration it is possible to control movement of mobile magnetic part 1 in a plane parallel to the plane of the windings in four directions, two along axis x and two along axis y. Two degrees of freedom of the mobile magnetic part are controlled. Similarly, it is possible to control two rotations around axes x and y: in this case there is control over four degrees of freedom.

By adding a fifth winding 405 which encircles all first four windings 401, 402, 403, 404 and which is positioned in the same plane x, y as these windings or in a parallel plane, it is possible to obtain movement of mobile magnetic part 1 in a direction perpendicular to the plane of windings 401 to 405, i.e. along axis z in this case.

Figure 7:
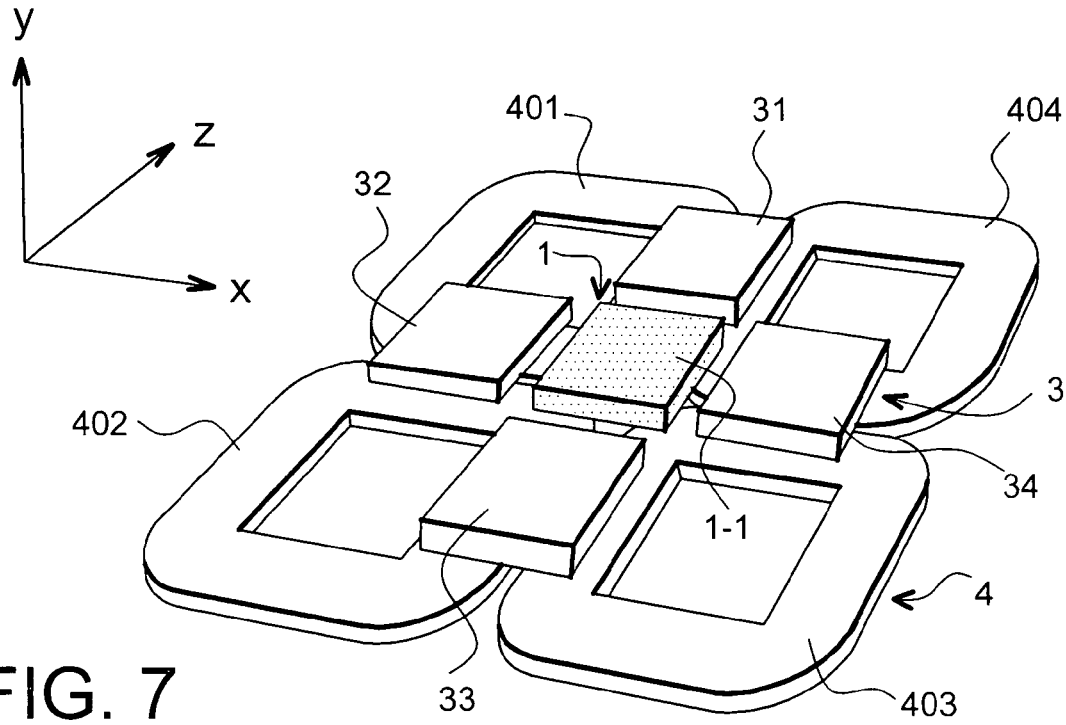
FIG. 7 shows an example of actuator of the invention whose fixed magnetic part consists of four members.

In FIG. 7, mobile magnetic part 1 is similar to the one in FIG. 6, as are means 4 for initiating movement with the exception of the fifth winding 405 which has been omitted for simplification purposes but could be present. The difference here concerns fixed magnetic means 3 which now comprise four fixed magnetic members 31, 32, 33, 34 forming a cross with mobile magnetic part 1. Each of these elements 31, 32, 33, 34 of fixed magnetic part 3 overlaps a coil portion of two windings respectively (401,404), (401, 402), (402,403), (403,404). Mobile magnetic part 1 can then be controlled along the same direction as those in FIG. 6. The addition of the fifth winding could be considered to obtain movement along a direction perpendicular to the plane of the first windings 401, 402, 403, 404.

In this configuration, the actuator can assume four stable positions, mobile magnetic part 1 can attach itself onto each of four fixed members 31, 32, 33, 34.

In FIG. 6, it only had two stable positions since there were only two fixed magnetic members 3-1.

Figure 8:
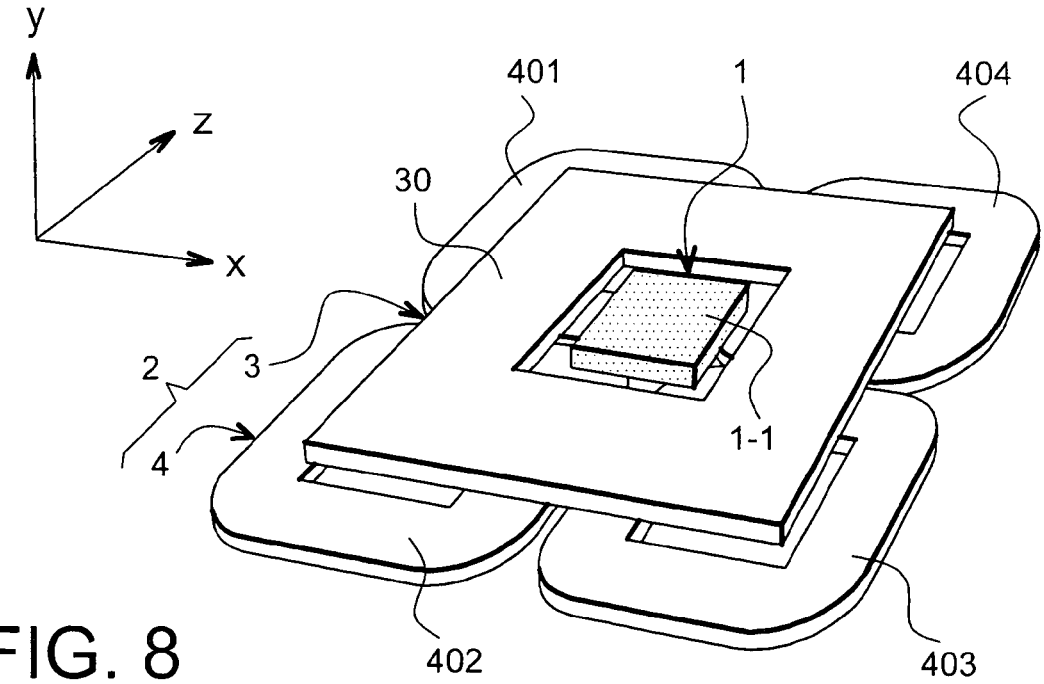
FIG. 8 shows an example of actuator of the invention whose fixed magnetic part comprises a single member which surrounds the mobile magnetic part.

In FIG. 8, there is no change relative to FIG. 7 either in mobile magnetic part 1 or in means 4 for initiating its movement. On the other hand, instead of consisting of several neighbouring members, fixed magnetic part 3 consists of a single member 30 which encircles mobile magnetic part 1. Mobile magnetic part 1 can then assume an infinity of stable positions when it attaches to fixed magnetic member 30. In this case a positioner is obtained.

In FIG. 8, the fixed magnetic part is shown as a recessed square wafer. Other forms can evidently be considered, a ring for example. The form of the mobile magnetic part must be compatible with that of the fixed magnetic part. For a ring-shaped fixed magnetic part, the corresponding mobile magnetic part would be disc-shaped.

Control over the position of the mobile magnetic part is similar to the control described for FIGS. 6 and 7. In this configuration also a fifth winding could be added to control the position in a plane perpendicular to that of the four first windings.

Such actuators may be used in group. A device with a plurality of actuators A of the invention is shown in FIGS. 9A, 9B. In FIG. 9A, the different actuators A are arranged in a matrix M on one same carrier 9, at the junction between n row conductors i1 to i3 and m column conductors j1 to j4 (n and m are whole numbers, n and m may be the same or different). In this manner, signals propagating over a layer formed of n row conductors i1 to i3 may be switched towards m column conductors j1, j2, j3, j4. These signals may be electric or optic signals depending upon the type of actuators A. On account of the bi-stability of actuators A of matrix M, the latter may be programmed and maintain its configuration without requiring an electricity supply.

If the actuators function as positioners, said matrix can be used to access several memories mounted in parallel, each position of the positioner corresponding to a memory position of one of the memories.

The actuators may be regrouped in a special matrix B as shown in FIG. 9B with one row conductor i1 and several column conductors j1 to j4. By connecting a bus onto row conductor i1, the signals it conveys may be oriented towards different column conductors j1 to j4 in relation to the status of the different actuators A.

Different steps in the microtechnological fabrication of microactuators of the invention will now be described. The mobile and fixed parts of these microactuators are magnets.

The means for initiating movement of the mobile magnetic parts consist of windings. In the figures only one microactuator can be seen, but in fact the advantage of this method is that it is possible to fabricate several at the same on one same substrate.

Figure 13A:
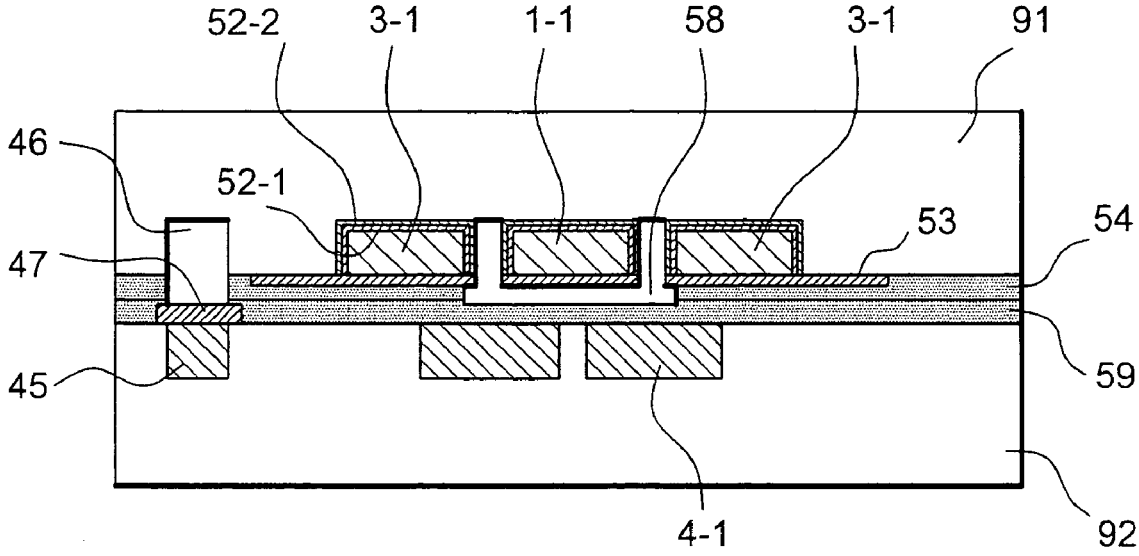
FIGS. 13A and 13B show the assembly and finishing steps of the substrates obtained in FIGS. 10I and 12G.
Figure 13B:
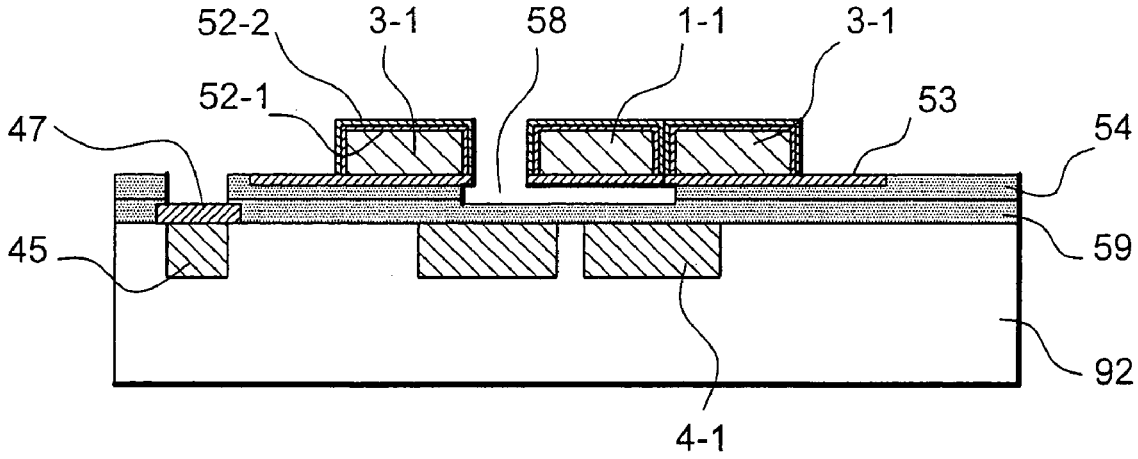
Figure 14A:
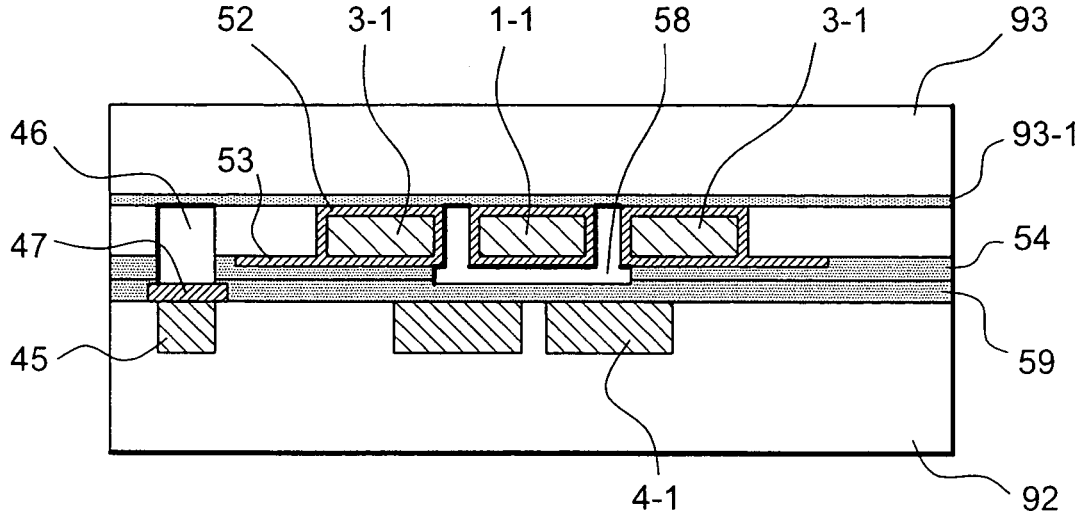
FIGS. 14A and 14B show the assembly and finishing steps of the substrates obtained in FIGS. 11I and 12G.
Figure 14B:
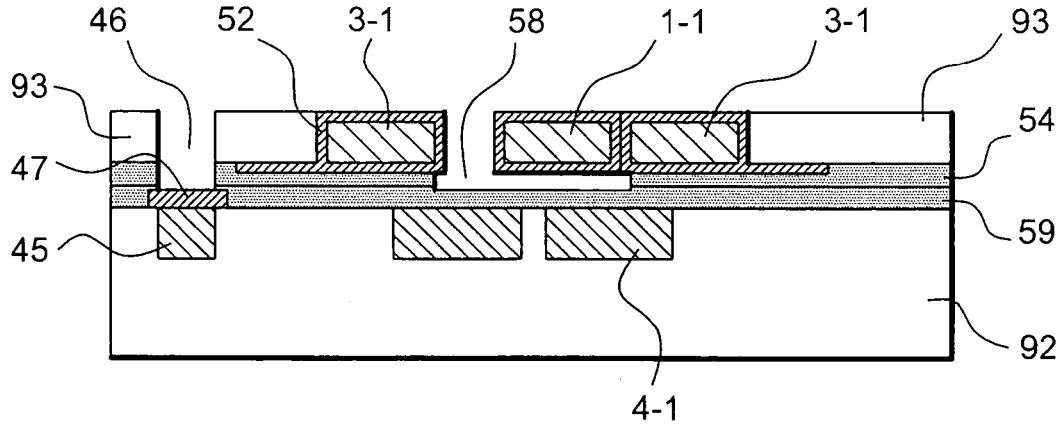

In FIGS. 14A, 14B the microactuator is fully embedded in the substrate made in two parts assembled together. In FIGS. 13A, 13B only the movement initiation means are embedded in the substrate also made in two assembled parts, the mobile and fixed magnetic parts are placed on the substrate. In FIGS. 13A, 13B, the two parts are conventional, solid semiconductor substrates while in FIGS. 14A, 14B one is a conventional solid substrate and the other is a silicon-on-insulator substrate (SOI). Said silicon substrate has a layer of insulating material 93-1, silicon oxide, buried in the silicon. Its advantage is that when etching is conducted, the layer of insulating material can act as stop layer.

On a first substrate, either a conventional solid substrate 91 in semiconductor material, or of SOI type 93 fabrication of the micromagnets is conducted (FIGS. 10A to 10I and 11A to 11I). On a second substrate 92 either solid in semiconductor material or of SOI type, the movement initiation means are fabricated in the form of one or more conductors able to be arranged in a winding (FIGS. 12A to 12G). In these FIGS. 12A to 12G a solid substrate is shown. However in FIG. 12B a dotted line schematises the position which would be taken by the insulating layer of a SOI substrate.

Figure 10A:
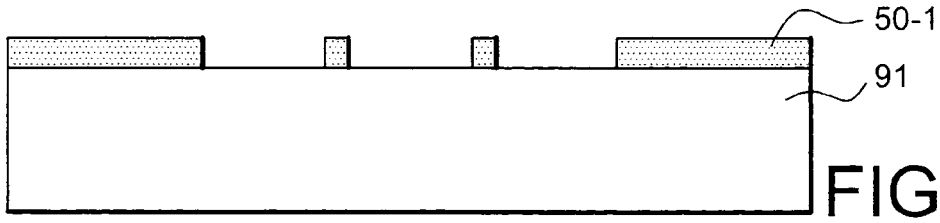
FIGS. 10A to 10I shows different steps in the fabrication of the fixed and mobile magnetic parts of an actuator of the invention, on a solid semiconductor substrate.
Figure 10B:
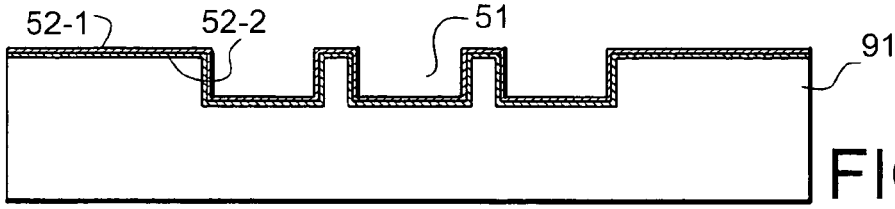
Figure 11A:
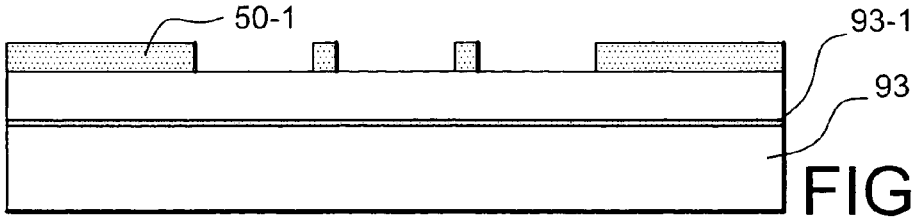
FIGS. 11A to 11I show different steps in the fabrication of the fixed and mobile magnetic parts of an actuator of the invention on a SOI-type semiconductor substrate.

Starting with first substrate 91, 93 the geometry of the magnets is delimited by photolithography. For this a resin 50-1 is used (FIGS. 10A, 11A).

In the first substrate 91, 93 chambers 51 are etched for the magnets. Etching may be dry etching. In SOI substrate 93 etching stops at the oxide layer 93-1. Resin 50-1 is removed. A conductive adherence sub-layer 52 is deposited on substrate 91, 93. This variant is only to be found in FIG. 10B.

Figure 11B:
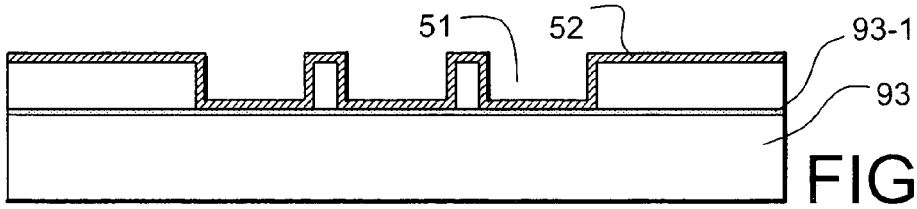

In FIG. 11B, there are two adherence sub-layers 52-1, 52-2, the second 52-2 being inserted between the first 52-1 and substrate 93. It enables good adhesion to substrate 93 of first sub-layer 52-1. It also provides protection for mobile magnet 1-1, subsequently fabricated, against corrosion. The first sub-layer may be in gold and the second in titanium. These two sub-layers could be used in the example in FIG. 10B.

Figure 10C:
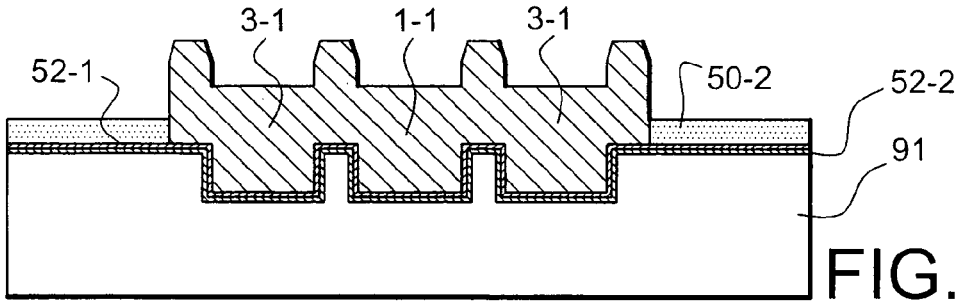
Figure 10D:
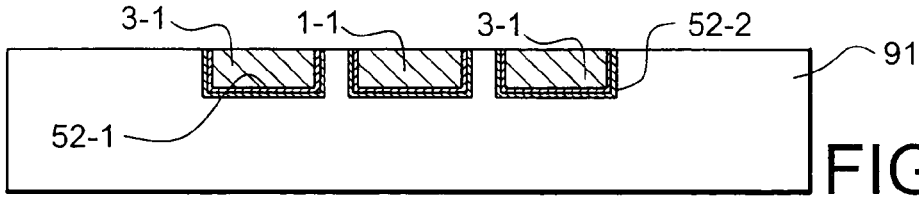
Figure 11C:
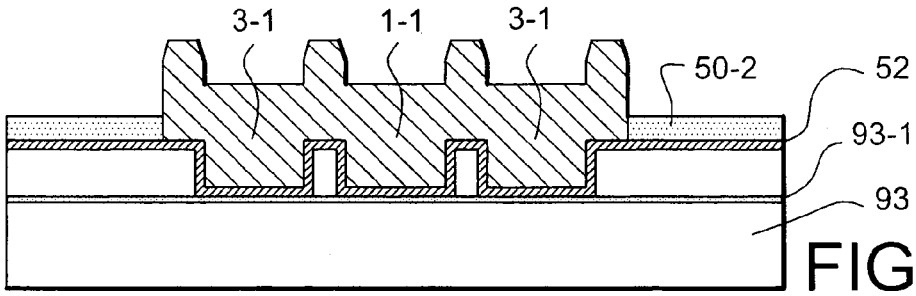

The magnet depositing zone is delimited by photolithography. The resin layer used carries reference 50-2. Magnets 3-1, 1-1 are deposited by electrolysis. The material used may be cobalt-platinum (FIGS. 10C, 11C).

Figure 11D:
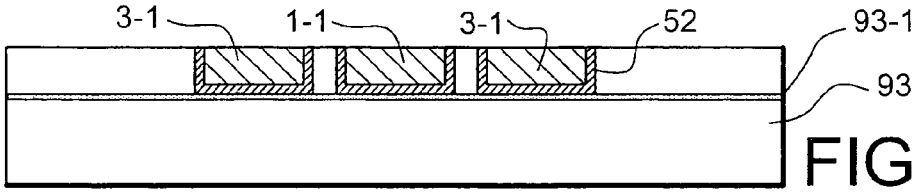

After a removal step of resin 50-2, a planarization step of the magnets is performed followed by a removal step of sub-layer 52 on the surface (FIG. 10D) or of the two sub-layers 52-1, 52-2 (FIG. 11D).

Figure 10E:
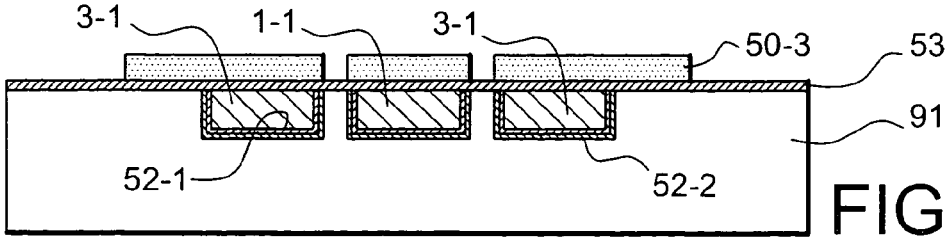
Figure 11E:
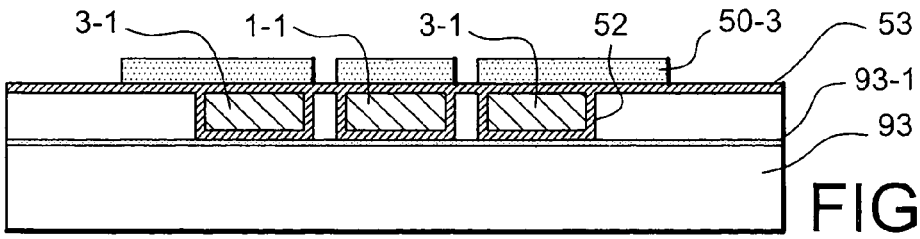

A conductor layer 53 is then deposited on the surface intended to form electric contacts C1, C2, C on magnets 3-1, 1-1. The geometry of contacts C1, C2, C is defined by photolithography. The resin carries reference 50-3 (FIGS. 10E, 11E). Since all the magnets are fabricated at the same time, the mobile magnet 1-1 also carries a conductor layer on its upper surface, it plays a protective role against corrosion.

Figure 10F:
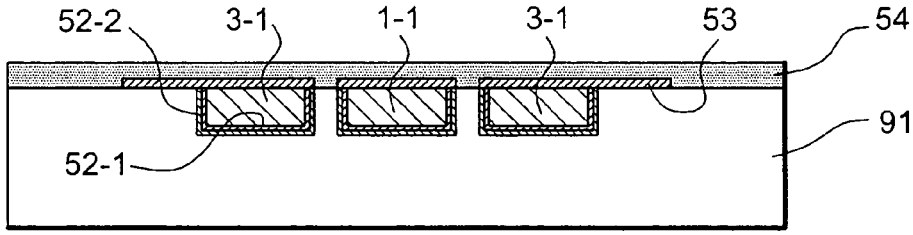
Figure 11F:
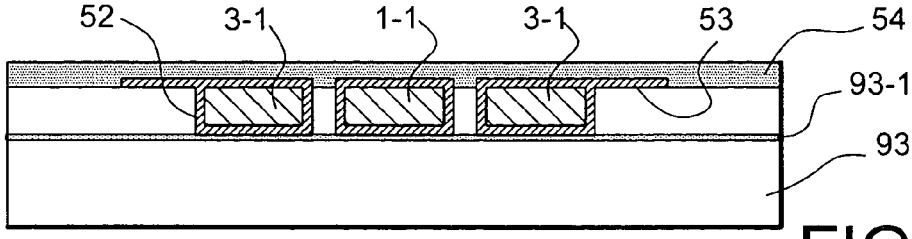

The following step is an etching step of conductor layer 53 to delimit contacts C1, C2, C. Resin 50-3 is removed. An insulating layer 54 is deposited on the surface, in $SiO_2$ for example, then a planarization step is performed (FIGS. 10F, 11F).

Figure 10G:
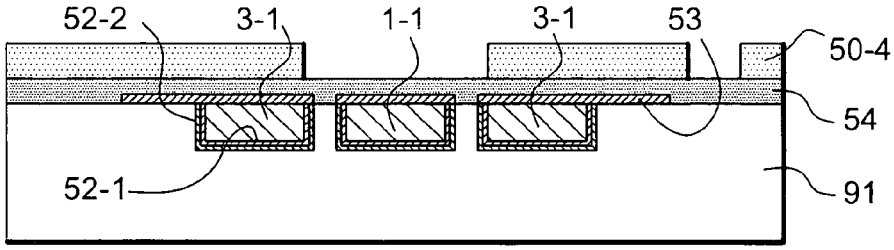
Figure 11G:
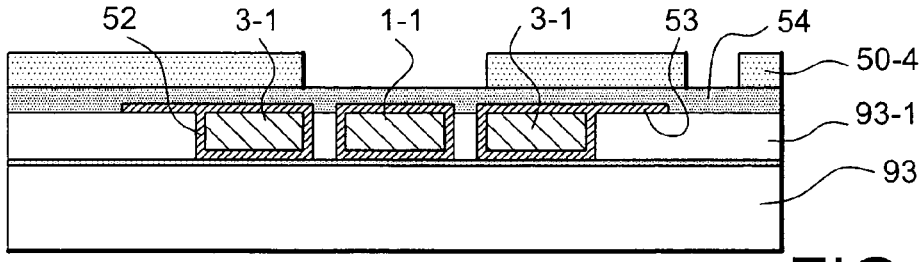

At least one opening 46 is now defined to make accessible the supply contacts to the conductor or conductors to be fabricated on the second substrate, and the geometry of the free space 58 surrounding mobile magnetic part 1-1 to allow its movement. This step is a photolithographic step and the resin used is denoted 50-4 (FIGS. 10G, 11G).

Figure 10H:
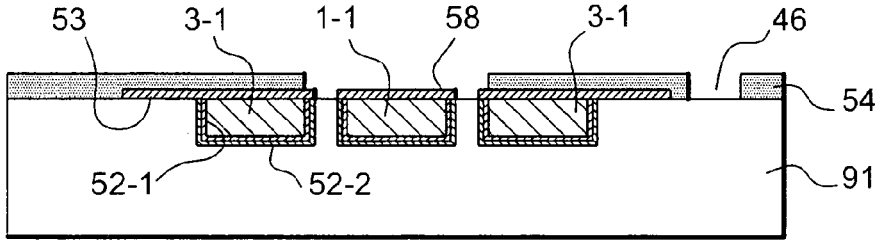
Figure 11H:
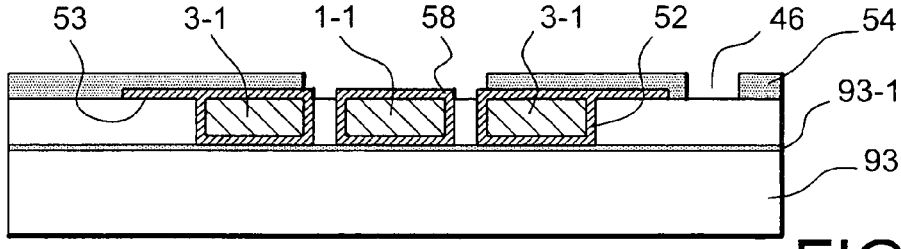

Next the insulator layer 54 is etched where there is no resin 50-4. Resin 50-4 is removed (FIGS. 10H, 11H). The mobile magnet 1-1 is now exposed and its surrounding area as far as fixed magnets 3-1.

Dry etching of substrate 91, 93 is then preformed at space 58 around mobile magnetic part 1-1 and at openings 46 which stops at the insulator layer for SOI substrates 93 (FIGS. 101, 111).

It is assumed that the actuator to be fabricated is similar to the one in FIG. 3A with a single conductor 4-1.

Figure 12A:
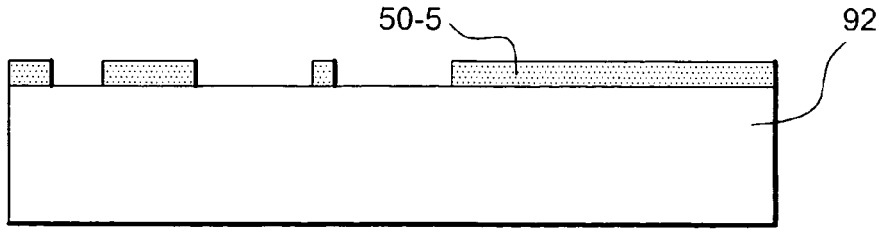
FIGS. 12A to 12G show different steps in the fabrication of means for initiating movement of the mobile magnetic part of an actuator of the invention on a semiconductor substrate.

On the second substrate 92, photolithography is used to define the geometry of conductor 4-1 and of its ends 45 which are to carry the supply contacts. The resin used carries reference 50-5 (FIG. 12A).

Figure 12B:
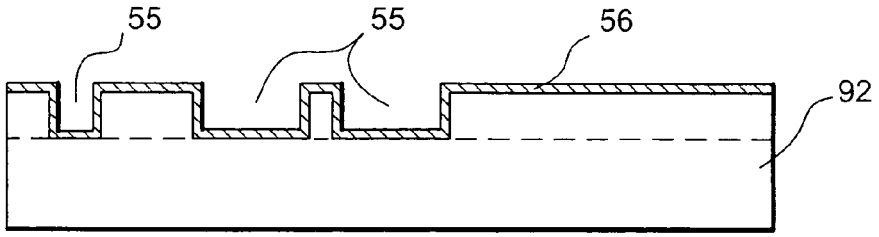

A chamber 55 is etched which is to house conductor 4-1. In a SOI substrate the etching of chamber 55 stops at the insulator layer. The depth of chamber 55 corresponds to the thickness of conductor 4-1. After removing resin 50-5, a conductive adherence sub-layer 56 is deposited on the surface (FIG. 12B). It may be made in copper for example. It is also possible to insert a second sub-layer as described for FIG. 10B. It may be in titanium for example.

Figure 12C:
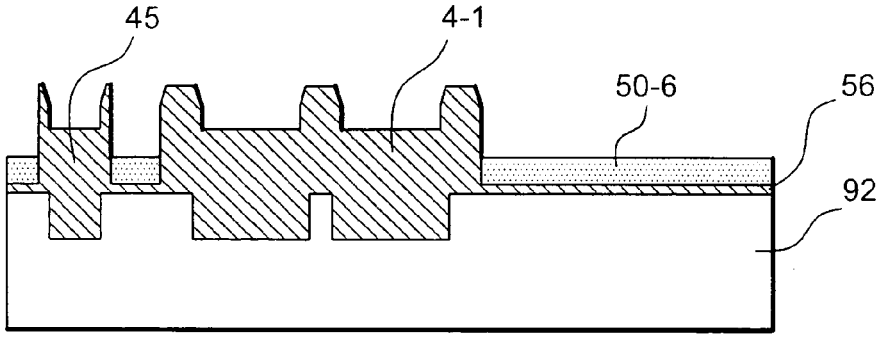

The conductor depositing zone is defined by photolithography. The resin used is denoted 50-6. Conductor 4-1 is deposited by electrolysis, its ends denoted 45 are clearly visible (FIG. 12C). The deposit may be copper.

Figure 12D:
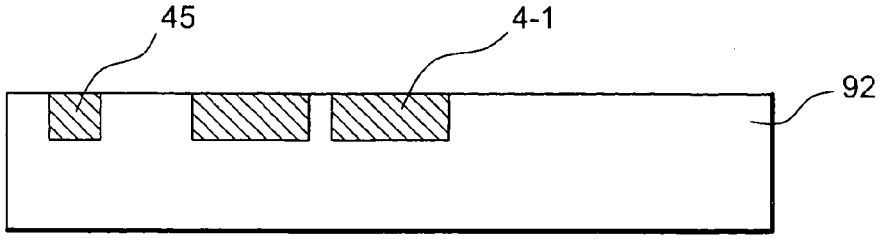

Resin 50-6 is removed, the conductor deposit is planarized. Conductive sub-layer 56 is etched on the surface for its removal (FIG. 12D).

Figure 12E:
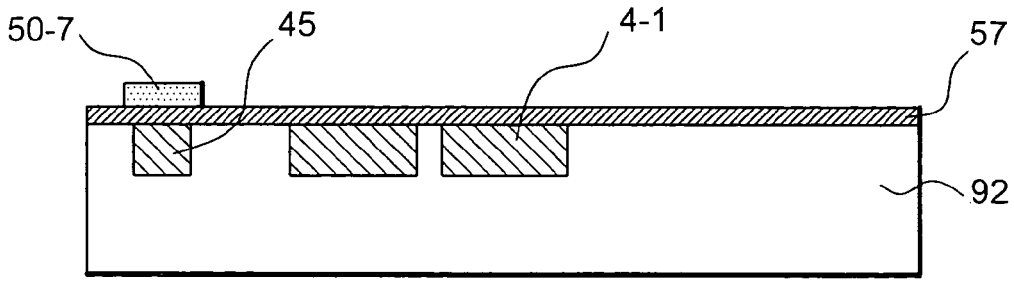

Then a conductor layer 57 is deposited on the surface intended to form the supply contacts 47 to conductor 4-1, these contacts 47 covering the ends 45 of conductor 4-1. The geometry of contacts 47 is defined by photolithography, the resin used being denoted 50-7 (FIG. 12E).

Figure 12F:
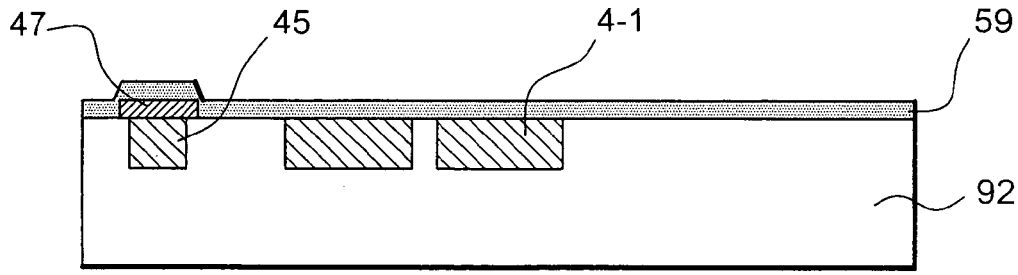

Conductor layer 57 is subsequently etched for its removal at all locations where it is not protected by resin 50-7. After removing resin 50-7, an insulating layer 59 is deposited on the surface. It may be made in silicon oxide $SiO_2$. It will insulate conductor 4-1 from magnets 3-1, 1-1 when assembling first substrate 91, 93 and second substrate 92 (FIG. 12F).

Figure 12G:
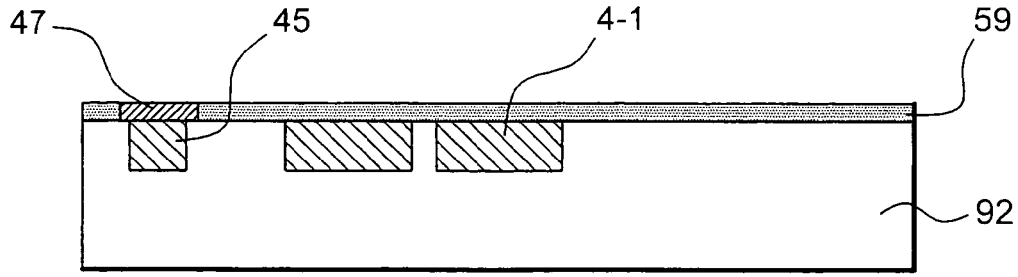

Surface planarization is conducted and contacts 47 are exposed (FIG. 12G).

Figure 10I:
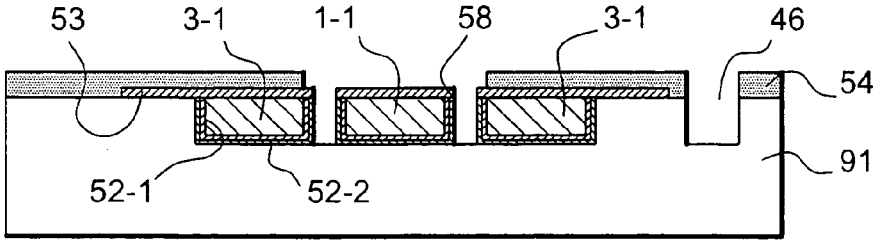
Figure 11I:
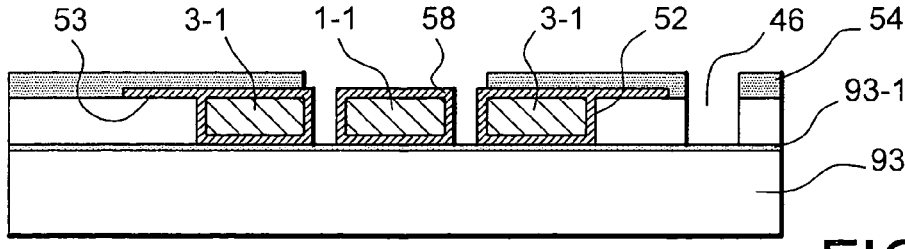

Placing them so that they face one another, the substrate in FIG. 10I is bonded to the substrate in FIG. 12G (FIG. 13A) or the substrate in figure 11I is bonded to the substrate in FIG. 12G (FIG. 14A).

It must now be ensured that magnets 1-1, 1-3 are magnetized as otherwise, when releasing mobile magnet 1-1, it will not be attracted by fixed magnets 3-1 which remain fully integral with the substrate via the adherence sub-layer.

The first substrate 91, 93 is removed in full or in part. This may be achieved by mechanical thinning and/or chemical attack. In FIG. 13B, substrate 91 has been completely removed while in FIG. 14B removal stopped at the oxide layer 93-1 and the underlying silicon of substrate 93 remains in place. Finally the oxide layer 93-1 is removed. Magnets 3-1, 1-1 are then embedded in the substrate consisting of the two assembled parts 92 and 93, but in FIG. 13B they are on the surface of substrate 92.

The actuator of the invention, should it occupy a volume of more than approximately 1 cubic centimeter, might be sensitive to the outside environment such as vibrations and impacts. Its performance might not be optimal in such disturbed environments. On the other hand, against all expectations, with smaller dimensions its performance is largely improved irrespective of the environment. The interaction between the fixed and mobile magnetic parts is favourable and does not bring any deterioration in performance as is the case with a much bulkier actuator.

Even though a certain number of embodiments of the present invention have been presented and described in detail, it will be understood that different changes and modifications may be made while remaining within the scope of the invention.

The invention claimed is:

1. Magnetic actuator comprising a fixed magnetic part (3) cooperating magnetically with a mobile magnetic part (1), means (4) for initiating movement of the mobile magnetic part (1), characterized in that the mobile magnetic part (1) comprises at least one magnet (1-1) and in that the fixed magnetic part (3) has at least two attraction zones (3-2) onto which the mobile magnetic part is able to come to attach itself, the mobile magnetic part (1) levitating when it is not attached to one of attraction zones (3-2), its movement being magnetically guided.

2. Magnetic actuator as in claim 1, characterized in that the fixed magnetic part (3) is made in a material chosen from the group of soft magnetic materials, hard magnetic materials, hysteresis materials, superconductor materials, diamagnetic materials, these materials being used alone or in combination.

3. Magnetic actuator as in claim 1, characterized in that means (4) for initiating movement of the mobile magnetic part (1) are magnetic means.

4. Magnetic actuator as in claim 3, characterized in that the means (4) for initiating movement of mobile magnetic part (1) are heating means (R) to heat fixed magnetic part (3).

5. Magnetic actuator as in claim 4, characterized in that the material of the fixed magnetic part (3) has a Curie temperature lower than that of magnet (1-1) of mobile magnetic part (1).

6. Magnetic actuator as in claim 4, characterized in that magnet (1-1) of mobile magnetic part (1) is heat insulated from fixed magnetic part (3).

7. Magnetic actuator as in claim 3, characterized in that means (4) for initiating movement of the mobile magnetic part set up a magnetic field in the vicinity of mobile magnetic part (1).

8. Magnetic actuator as in claim 7, characterized in that the means (4) for initiating movement of mobile magnetic part (1) consist of at least one conductor (4-1) through a which an electric current is able to pass.

9. Magnetic actuator as in claim 8, characterized in that it comprises means (5,6) for servo-controlling the current to be circulated in conductor (4-1) in relation to the position of mobile magnetic part (1) so that it is able to assume a plurality of stable levitating positions.

10. Magnetic actuator as in claim 8, characterized in that the conductor (40) surrounds the fixed magnetic part (3).

11. Magnetic actuator as in claim 8, characterized in that conductor (4-1) is in the form of a substantially planar winding.

12. Magnetic actuator as in claim 1, characterized in that the fixed (3) and mobile (1) magnetic parts are substantially planar.

13. Magnetic actuator as in claim 12, characterized in that the fixed (3) and mobile (1) magnetic parts are arranged substantially in the same plane.

14. Magnetic actuator as in claim 8, characterized in that conductor (4-1) firstly and fixed (3) and mobile (1) magnetic parts secondly are arranged in substantially parallel planes.

15. Magnetic actuator as in claim 1, characterized in that fixed (3) magnetic part consists of a member (30) which surrounds mobile magnetic part (1).

16. Magnetic actuator as in claim 1, characterized in that the fixed magnetic part (3) consists of several members (3-1), the mobile magnetic part (1) coming to attach itself onto one or other of members (3-1) of fixed magnetic part (3).

17. Magnetic actuator as in claim 16, in which the fixed magnetic part (3) comprises several members (3-1) oriented along different planes, the mobile magnetic part (1) assuming the orientation of member (3-1) to which it is attached.

18. Magnetic actuator as in claim 1, characterized in that the magnetization of fixed magnetic part (3) and that of mobile magnetic part (1) are directed in one same direction.

19. Magnetic actuator as in claim 1, characterized in that the magnetization of fixed magnetic part (3) and that of mobile magnetic part (1) are directed in opposite directions.

20. Magnetic actuator as in claim 17, characterized in that the means (4) for initiating movement of mobile magnetic part (1) are able to initiate rotational movement.

21. Magnetic actuator as in claim 1, characterized in that the fixed magnetic part (3), at an attraction zone (3-2), comprises a pair of electric contacts (C1,C2), and in that the mobile magnetic part (1) comprises at least one electric contact (C), the mobile magnetic part (1) connecting the two contacts (C1,C2) of the pair when it attaches itself to attraction zone (3-2).

22. Magnetic actuator as in claim 1, characterized in that mobile magnetic part (1) comprises a reflective zone (10) intended to reflect a light ray (F).

23. Magnetic actuator as in claim 1, characterized in that it is fabricated on an amagnetic substrate (9), the means (4) for initiating movement of mobile magnetic part (1) being embedded in the substrate.

24. Matrix of magnetic actuators characterized in that it comprises a plurality of magnetic actuators (A) according to claim 1, these magnetic actuators being grouped together on one same carrier (9).

25. Device according to claim 1 characterized in that it comprises at least one magnetic actuator.

* * * * *